US008297475B2

(12) United States Patent
Limbert et al.

(10) Patent No.: US 8,297,475 B2
(45) Date of Patent: Oct. 30, 2012

(54) DISPENSING PUMP FOR CONTAINER

(75) Inventors: Dean Philip Limbert, Chellaston Derby (GB); Shaun Kerry Matthews, Gaddesby (GB)

(73) Assignee: Pibed Limited, Denby, Derbyshire (GB)

( * ) Notice: Subject to any disclaimer, the term of this patent is extended or adjusted under 35 U.S.C. 154(b) by 860 days.

(21) Appl. No.: 12/357,181

(22) Filed: Jan. 21, 2009

(65) Prior Publication Data

US 2009/0120966 A1 May 14, 2009

Related U.S. Application Data

(63) Continuation of application No. 11/981,895, filed on Nov. 1, 2007, now abandoned.

(51) Int. Cl.
*B67D 7/76* (2010.01)

(52) U.S. Cl. ..... 222/190; 222/153.07; 222/321.8

(58) Field of Classification Search ..... 222/153.07, 222/190, 321.8, 321.9; 239/333
See application file for complete search history.

(56) References Cited

U.S. PATENT DOCUMENTS

| | | | | |
|---|---|---|---|---|
| 4,524,888 | A | 6/1985 | Tada | |
| 5,326,000 | A * | 7/1994 | Fuchs | 222/321.7 |
| 5,462,208 | A * | 10/1995 | Stahley et al. | 222/207 |
| 5,975,370 | A | 11/1999 | Durliat | |
| 5,992,703 | A * | 11/1999 | Fuchs | 222/321.9 |
| 6,669,056 | B2 * | 12/2003 | Bistolfi | 222/145.6 |
| 6,923,346 | B2 * | 8/2005 | Foster et al. | 222/190 |
| 7,850,048 | B2 * | 12/2010 | Arminak | 222/190 |
| 2006/0237483 | A1 * | 10/2006 | Ophardt | 222/207 |
| 2007/0151985 | A1 | 7/2007 | Iizuka et al. | |

FOREIGN PATENT DOCUMENTS

| | | |
|---|---|---|
| WO | 9303857 | 3/1993 |
| WO | 2004073876 | 9/2004 |
| WO | 2007091882 | 8/2007 |

OTHER PUBLICATIONS

PCT International Search Report, Apr. 15, 2009, pp. 1-5.
ISA, PCT Written Opinion of the International Searching Authority, Apr. 15, 2009, pp. 1-11.
PCT International Preliminary Report on Patentability, Sep. 21, 2009, pp. 1-11.

* cited by examiner

*Primary Examiner* — Kevin P Shaver
*Assistant Examiner* — Daniel R Shearer
(74) *Attorney, Agent, or Firm* — McAndrews, Held & Malloy, Ltd.

(57) ABSTRACT

A pump for dispensing foam that includes a pump head having a mixing chamber and a porous member. The pump head includes a tube and diaphragm. The pump includes a cap having a body defining a cavity that receives the tube. The cap is connected to the diaphragm to define an air chamber communicating with the mixing chamber. The pump includes a spring system received in the tube and cavity. The tube, cavity, and spring system define a liquid chamber that communicates with the mixing chamber. The spring system includes a spring positioned to be compressed such that liquid is urged from the liquid chamber to the mixing chamber and the diaphragm is configured to be compressed such that air is drawn from the air chamber to the mixing chamber. The liquid and air commingle into a mixture that is pushed through the porous member to form a foam. A container having a mechanism that delivers liquid from a container to a mouth and that moves between an extended position and a depressed position to deliver the contents of the container to the mouth and a removable securing cap that retains the mechanism in the depressed position.

17 Claims, 8 Drawing Sheets

DISPENSING PUMP FOR CONTAINER

REFERENCE TO RELATED APPLICATION

This application is a continuation of U.S. application Ser. No. 11/981,895 which was filed on Nov. 1, 2007, is now abandoned and is incorporated by reference herein in its entirety.

FIELD OF THE INVENTION

The present invention generally relates to a pump and dispenser for dispensing foamed liquids. More particularly, the present invention relates to an upright pump that dispenses liquid soap as foam. Further, the present invention also generally relates to an upright container having a delivery mechanism that may be transported in a depressed position and a securing cap for retaining the mechanism in the depressed position.

BACKGROUND OF THE INVENTION

Foamed soap has become extremely popular. Foamed soap is dispensed by wall-mounted dispensers generally in commercial applications, such as in restrooms or hospitals, or by hand-held or upright countertop dispensers. The hand-held dispensers are popular because they, unlike wall-mounted dispensers, may easily be transported to different areas of need and then easily disposed of. Hand-held dispensers may be used in the growing home healthcare and food handling locations and thus cover a broader range of traditional hand washing uses then wall-mounted dispensers.

Hand-held foam soap dispensers operate by use of a pump that differs from a conventional liquid dispensing pump by receiving liquid soap from a soap container, combining the liquid soap with air, and dispensing the liquid and air combination as a foam. These foam pumps thus typically include many discrete parts, are mechanically and structurally more complex than liquid pumps, and require more assembly stages than are required for a conventional liquid pump. The number of parts and assembly stages increase the cost and time required to manufacture a foam pump for a hand-held dispenser.

SUMMARY OF THE INVENTION

Certain embodiments of the present invention provide a pump that mounts to a bottle, makes foam of the liquid in the bottle, and dispenses the foam. The pump includes pump body that forms a liquid pump body that defines a pump body cavity that extends through the liquid pump body to an inlet passage that communicates with an interior of the bottle. The pump includes an inlet valve mounted to the liquid pump body that opens in response to pressure in the bottle that is greater than pressure in the pump body cavity and that closes to prevent communication between the interior of the bottle and the pump body cavity in response to pressure in the pump body cavity that is greater than pressure in the bottle. The pump includes a pump head including a nozzle section at an upper end of the pump head and a head tube extending from the nozzle section, wherein the nozzle section defines a mouth, the pump head defines a pump head cavity that extends from the mouth through the head tube, and an outer surface of the head tube is sized and configured to closely fit within the pump body cavity so that the head tube slidingly moves within and along the pump body cavity. The pump includes a porous member that is positioned within the pump head cavity. The pump includes a spring support sized to at least partially extend into the pump head cavity. The spring support is formed to prevent passage of liquid around the spring support into the pump head cavity and defines a spring support passage that communicates with the pump head cavity and the pump body cavity. The pump includes an outlet valve that opens to permit communication between the pump head cavity and the pump body cavity in response to pressure in the pump body cavity and that closes to prevent communication between the pump head cavity and the pump body cavity when not opened by pressure in the pump body cavity. The pump includes a pump spring positioned at least partially within the pump body cavity that urges the pump head tube and spring support away from the inlet passage. The pump includes a flexible diaphragm secured to the pump head at a location separated from the pump body that extends around the pump head and extends from the location at which it is secured to the pump head to the pump body. The diaphragm, the pump body and the pump head define an air chamber, and movement of the pump head tube toward the inlet passage deforms the diaphragm and thereby reduces the volume of the air chamber. The pump head defines one or more air passageways that communicate with the air chamber and the pump head cavity located between the outlet valve seat and the porous member.

Certain embodiments of the present invention provide a foamed soap dispenser. The dispenser includes a container carrying liquid soap and a pump assembly connected to the container. The pump assembly includes a pump head portion, a spring portion and a cap portion. The pump head portion includes a tube and a diaphragm, and the cap portion is configured to receive the tube and be connected to the diaphragm to define an air chamber. The spring portion includes a spring and a support member that are received within the tube and the cap portion to define a liquid chamber that receives liquid from the container through the cap portion. The liquid chamber and air chamber are in communication with a mixing chamber in the pump head portion proximate a porous member. When the pump head portion is moved to a depressed position, the support member is configured to compress the spring such that liquid flows from the liquid chamber to the mixing chamber and the diaphragm is collapsed such that air flows from the air chamber to the mixing chamber, whereby the air and liquid commingle in the mixing chamber and the air liquid mixture passes through the porous member and is dispensed from the pump head as a foam.

Certain embodiments of the present invention provide a foamed soap dispenser. The dispenser includes a container carrying liquid and a pump assembly configured to be secured to the container. The pump assembly is configured to move between an extended position and a depressed position such that, when the pump assembly is moved from the extended position to the depressed position, the pump assembly draws liquid from the container and dispenses the liquid as a foam. The dispenser includes a securing cap that is configured to be detachably connected to the pump assembly such that the pump assembly is maintained in the depressed position.

Figure 1:
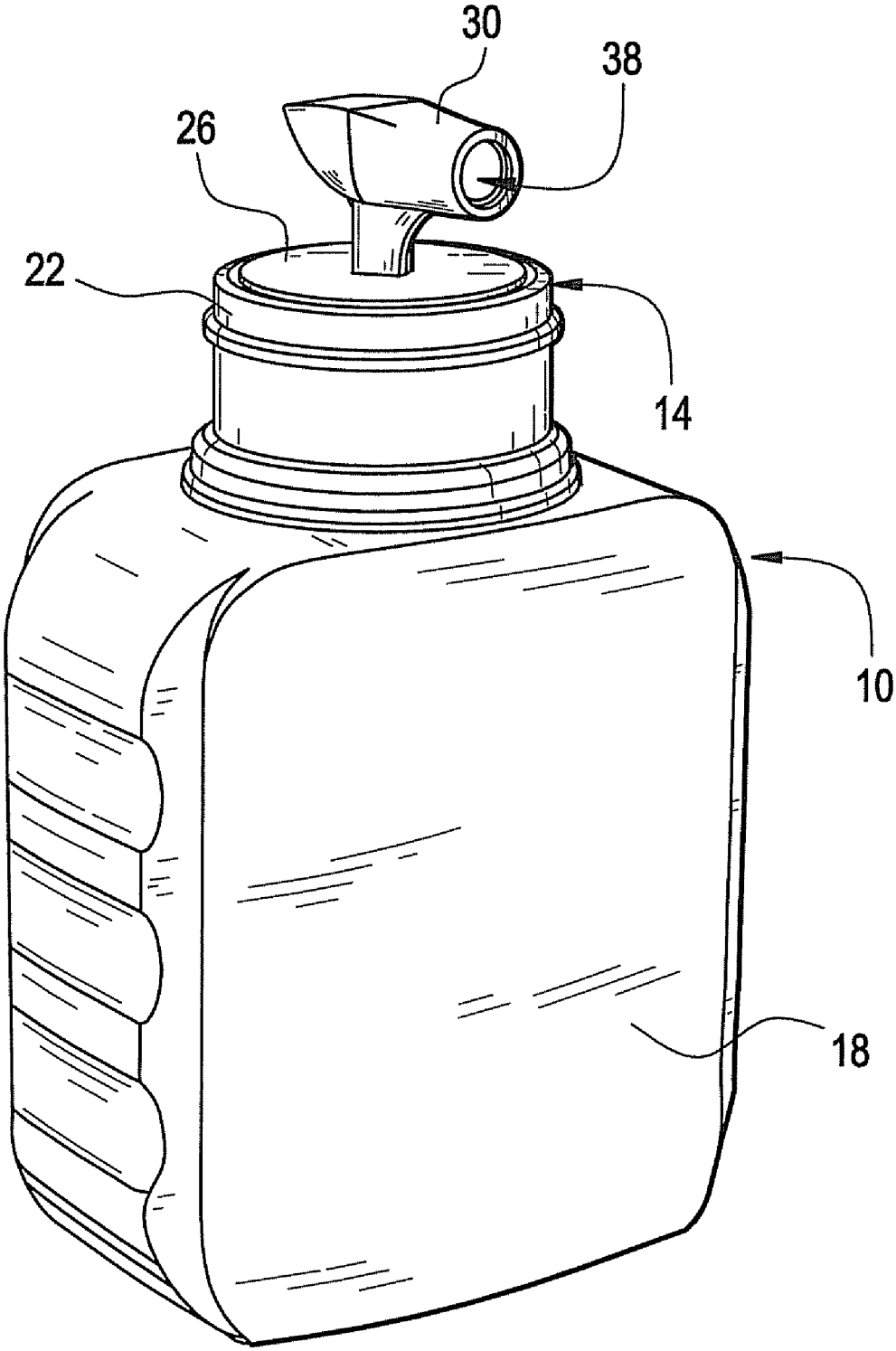
FIG. 1 illustrates a front isometric view of a hand-held foam soap dispenser that has a foam pump according to the present invention in its depressed position.

It should be understood that the invention is not limited to the details of construction and the arrangement of the components set forth in the following descriptions of embodiments of the invention and illustrated in the drawings. The invention may be practiced in other embodiments and carried out other than as described and depicted. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates a front isometric view of a hand-held foam soap dispenser 10 according to an embodiment of the present invention. The dispenser 10 includes a foam pump 14 mounted to a container 18. The container 18 is preferably relatively rigid. The container 18 carries liquid therein, and, by way of example only, the container 18 carries liquid soap.

The foam pump 14 is shown in FIG. 1 in its depressed position and includes a cap 22, a disc-shaped striker 26, and a pump head 30 that extends upwardly from the striker 26. In this embodiment, the cap 22 functions as both a body of the foam pump 14 and a closure for the container 18. The foam pump 14 is detachably connected to the container 18. The cap 22 and container 18 may each include threads such that the cap 22 may be threadably connected to and disconnected from the container 18. The striker 26 is received and may be secured within the cap 22 when the foam pump 14 is in the depressed position. The pump head 30 has a mouth 38 through which foamed soap is dispensed.

Figure 2:
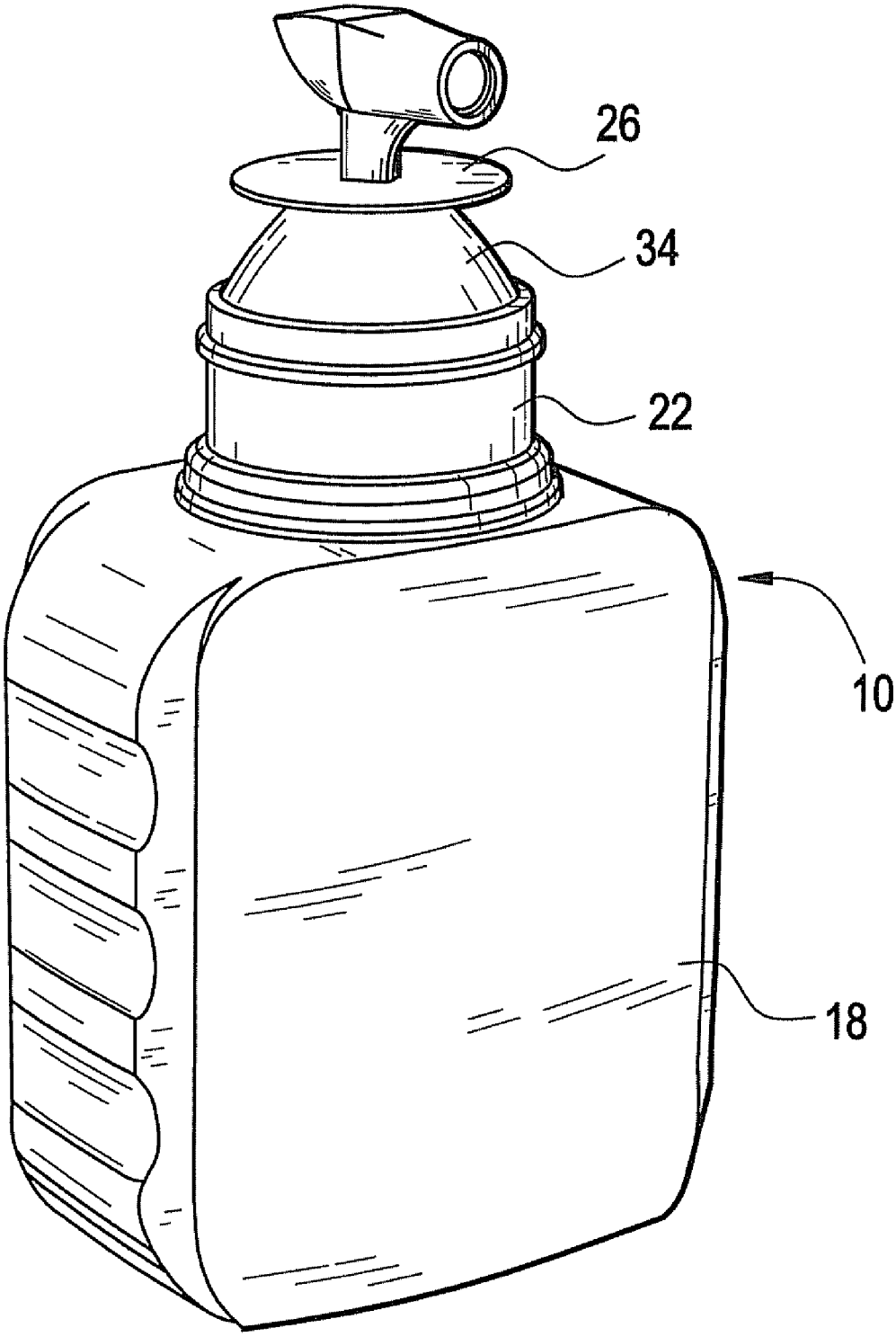
FIG. 2 illustrates a front isometric view of the dispenser of FIG. 1 with its foam pump in the extended position.

FIG. 2 illustrates a front isometric view of the dispenser 10 of FIG. 1 with the foam pump 14 in the extended position. When the pump 14 is in the extended position, the striker 26 is above the cap 22. A conical diaphragm 34 extends downwardly from the striker 26 to the cap 22. The diaphragm 34 is made of a flexible material so that it deforms to be positioned within the cap 22 when the foam pump 14 is in the depressed position. The diaphragm 34 extends upwardly from the cap 22 when the foam pump 14 is in the extended position. Preferably, and by way of example only, the diaphragm 34 has a wall section that is between 0.015 inches (0.381 mm) and 0.060 inches (1.524 mm) thick. The material of which the diaphragm 34 is made varies according to the chemical constituents of the foaming liquid carried in the container 18. Preferably, the diaphragm 34 may be made of injection molded thermoplastic elastomer, such as Santoprene™. The diaphragm 34, however, may be made of alternative thermoplastic and thermoset elastomers, such as, by way of example only, silicon, nitrile, or flourosilicon.

Figure 3:
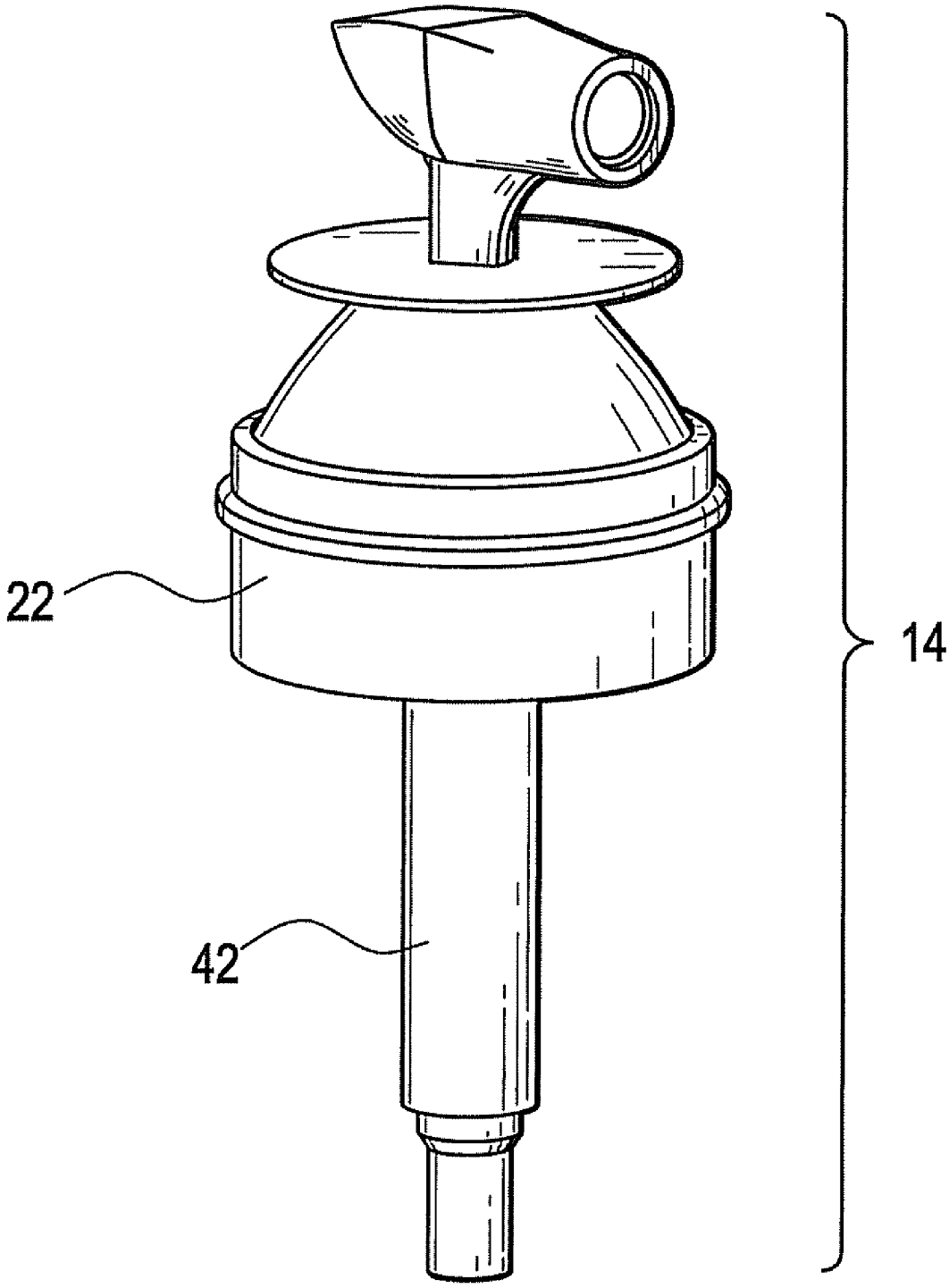
FIG. 3 illustrates a front isometric view of the foam pump of FIG. 1 in the extended position.

FIG. 3 illustrates a front isometric view of the foam pump 14 in the extended position. A cylindrical liquid pump body 42 extends downwardly from the cap 22. When the foam pump 14 is mounted to the container 18 (FIG. 1), the liquid pump body 42 extends into the container 18. A dip tube (not shown) may be connected to and extend from the liquid pump body 42. The dip tube may be curved, inverted, and/or extend further into the container 18 when the foam pump 14 is mounted to the container 18 to provide a passage for liquid within the container 18 into the liquid pump body 42.

Figure 4:
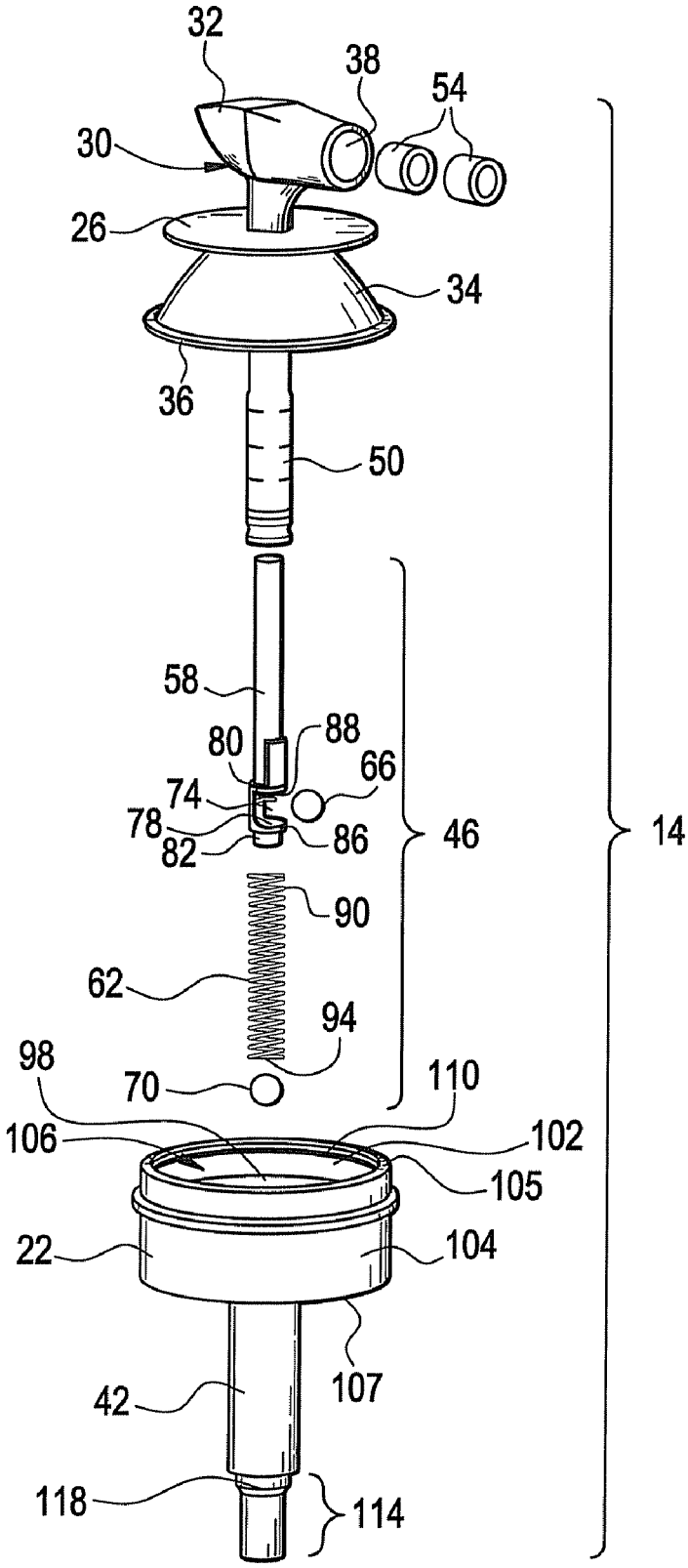
FIG. 4 illustrates an exploded view of the foam pump of FIG. 3.

FIG. 4 illustrates an exploded view of the foam pump 14 of FIG. 3. The foam pump 14 includes the pump head 30, a spring system 46 and the cap 22. The pump head 30 includes a nozzle section 32 at its uppermost end that forms the mouth 38. The striker 26 is located below the nozzle section 32 and the diaphragm 34 extends downwardly from the striker 26 and outwardly from the nozzle section 32. The pump head 30 includes a cylindrical pump head tube 50 that extends downwardly from the striker 26 within and beyond the diaphragm 34. The diaphragm 34 includes a flat rim 36 extending around its periphery at its furthest extent from the striker 26. As indicated by FIG. 4, two gauze tubes 54 are positioned in the mouth 38.

The spring system 46 includes a spring support 58, a return spring 62, an outlet ball 66, and an inlet ball 70. The spring support 58, spring 62, and balls 66 and 70 may, by way of example only, be made of metal or plastic. The spring support 58 defines near its lower most extent a gap 74, a seat 78 adjacent to the gap 74, and a flexible tab 80 that extends into the gap 74. The outlet ball 66 is positioned in the gap 74 on the seat 78 and is urged onto the seat 78 by the tab 80. The spring support 58 also defines a top ledge 88 above the gap 74, a bottom ledge 86 adjacent to the seat 78, and a cylindrical end 82 that extends downwardly from the bottom ledge 86 to form the lower-most section of the spring support 58. The end 82 is configured to be received within a portion of the spring 62 such that a top end 90 of the spring 62 abuts the ledge 86. The inlet ball 70 is sized to abut a bottom end 94 of the spring 62.

Figure 5:
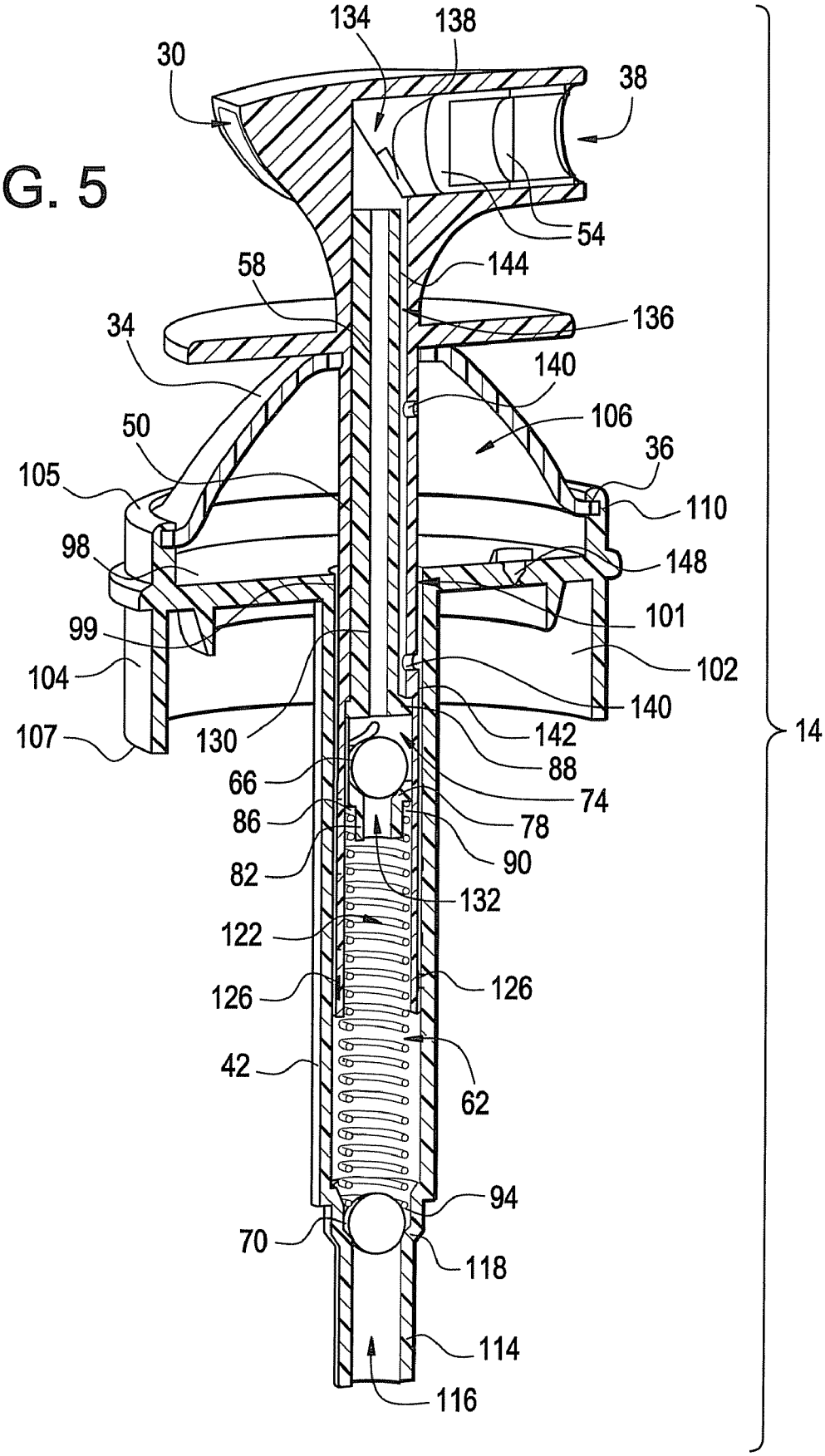
FIG. 5 illustrates a cross-sectional side view of the foam pump of FIG. 3.

As shown in FIGS. 4 and 5, the cap 22 has a generally cylindrical outer wall 104 and an interior base 98 that extends inwardly from the outer cylindrical wall 104 at a location between the upper end 105 and the lower end 107 of the outer cylindrical wall 104. The wall 104 has an inner surface 102. A groove 110 extends around the wall 104 and into the wall 104 from the inner surface 102 at a location that is near the upper end 105. The groove 110 is sized to accept the rim 36 of the diaphragm 34. The liquid pump body 42 extends downwardly from the interior base 98. The base 98 defines a hole 99 that opens into a cavity 101 that is defined by and extends the length of the liquid pump body 42. The liquid pump body 42 defines a seat 118 at the lower extent of the cavity 101. The seat 118 is sized to support the inlet ball 70 within the cavity 101. A narrowed section 114 of the liquid pump body 42 extends downwardly from the seat 118. The seat 118 and the section 114 define a passage 116 through which liquid may enter the cavity 101.

As shown in FIG. 5, the pump head tube 50 defines an interior cavity 136 that extends along the tube 50 and communicates with the mouth 38. The cavity 136 is sized to receive the spring support 58. The pump head tube 50 defines a support ledge 142 along the interior cavity 136. The top ledge 88 of the spring support 58 abuts the support ledge 142 when the spring support 58 is inserted in the cavity 136 to position the spring support 58 within the cavity 136. The ledge 88 abutting the support ledge 142 at least substantially prevents liquid or air from passing along the cavity 136 between the ledges 88 and 142. An upper portion of the spring 62 is received in the cavity 136 of the pump head tube 50, and the top end 90 of the spring 62 receives the end 82 of the spring support 58. The spring 62 abuts the ledge 86 of the spring support 58. A lower portion of the spring 62 extends downwardly from the pump head tube 50 into cavity 101 defined by the liquid pump body 42. The bottom end 94 of the spring 62 engages the inlet ball 70 positioned in the seat 118 of the liquid pump body 42. The spring 62 urges the spring support 58 and pump head 30 upwardly from the liquid pump body 42 to urge the foam pump 14 to the extended position.

As shown in the assembled foam pump 14 of FIG. 5, the pump head tube 50 is sized to closely fit within the cavity 101 and to telescopingly move along the cavity 101. The pump head tube 50 includes a seal 126 in a groove extending around the outer periphery of the tube 50 to maintain a seal between the pump head tube 50 and the liquid pump body 42. The cavity 101 from the seat 118 to the lower extent of the head tube 50 and the cavity 136 in the head tube 50 from its lower extent to the bottom ledge 86 define a cylindrical liquid chamber 122 which receives liquid soap from the container 18 (FIG. 1). The spring 62 urges the spring support 58 and the pump head tube 50 upwardly away from the seat 118. Upward movement of the pump head tube 50 lowers the pressure in the liquid chamber 122, drawing the outlet ball 66 against the seat 78 and drawing the inlet ball 70 from the seat 118. The inlet ball 70 allows liquid to flow into the liquid chamber 122 of the foam pump 14 through the section 114 from the container 18.

The spring support 58 defines a cylindrical first liquid passageway 130 that communicates with the gap 74 and extends upwardly from the gap 74 toward the mouth 38. A second liquid passageway 132 extends through the seat 78 and the end 82 of the spring support 58 to communicate with the gap 74 and the liquid chamber 122. The first liquid passageway 130 leads to a mixing chamber 134 in the pump head 30 that is adjacent to the upper extent of the spring support 58. The mixing chamber 134 includes a baffle or static mix feature 138 that is positioned between the liquid passageway 130 and a series of two gauze tubes 54 in the mouth 38 of the pump head 30. The gauze tubes 54 may be made of gauze or a mesh or any other kind of porous member that allows the passage of liquid and air therethrough. By way of example only, the gauze tubes 54 may be made of fabric, plastic, or metal. The pump head 30 may carry one or more gauze tubes 54 in the mouth 38.

The portion of the spring support 58 that extends through the cavity 136 upwardly from the support ledge 142 to the mixing chamber 134 is sized and configured to define a passageway 144 between the spring support 58 and the pump head tube 50. The air passageway 144 extends from the lower ledge 142 of the tube 50 to the mixing chamber 134. The air chamber 106 is formed by the interior base 98, the wall 104, the diaphragm 34 and the pump head tube 50. As shown in FIG. 5, the diaphragm 34 closely, and preferably resiliently, surrounds the pump head tube 50 below and adjacent to the striker 26. The pump head tube 50 includes two air inlets 140 that allow air to travel from the passageway 144 to an air chamber 106 that surrounds the pump head tube 50.

The pump head tube 50 may include more than one air inlet 140 or have the inlet 140 at different locations depending on whether the foam pump 14 is used with an upright hand soap container or in an inverted position with a wall-mounted soap dispenser. The positions of the air inlet 140 may also be varied in order to reduce the amount of air that is drawn into the air chamber 106 after passing from the air chamber 106 into the air passageway 144. The base 98 includes an air hole 148 that extends from the air chamber 106 into the container 18 (FIG. 1) when the foam pump 14 is mounted to the container 18. The air hole 148 allows air to enter the container 18 from the air chamber 106 to maintain the pressure in the container 18 such that the container 18 does not collapse as liquid is withdrawn from the container 18. Alternatively, if the container 18 is a collapsing container, then the base 98 does not include the air hole 148.

Figure 6:
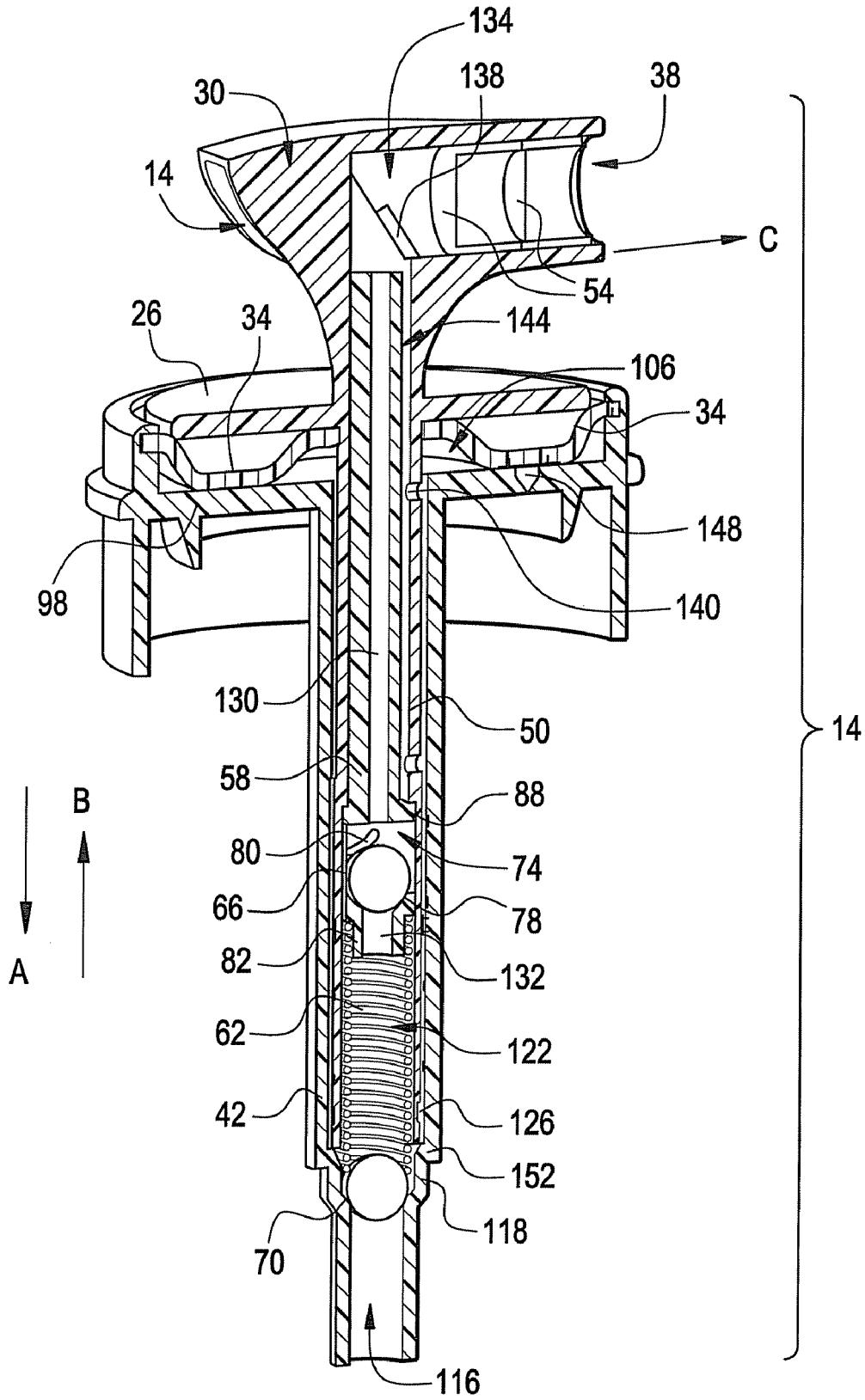
FIG. 6 illustrates a cross-sectional side view of the foam pump of FIG. 3 in the depressed position.

FIG. 6 illustrates a cross-sectional side view of the foam pump 14 of FIG. 3 in the depressed position. When the foam pump 14 is moved into the depressed position, the striker 26 is pushed down into the cap 22 and the diaphragm 34 is collapsed between the striker 26 and the base 98 compressing air in the air chamber 106. When the diaphragm 34 is collapsed, the diaphragm 34 covers and seals the air hole 148 in the base 98. Also, when the foam pump 14 is moved into the depressed position, the pump head tube 50 is moved downward within the liquid pump body 42 in the direction of Arrow A until the tube 50 engages a ledge 152 proximate the seat 118 of the liquid pump body 42 and compressing liquid in the liquid chamber 122. As the tube 50 is moved downward within the liquid pump body 42, the tube 50 engages the top ledge 88 of the spring support 58 and pushes the spring support 58 downward in the direction of Arrow A such that the spring 62 is compressed between the inlet ball 70 and the spring support 58. When the foam pump 14 is released from the depressed position, the spring 62 decompresses and pushes the spring support 58, and thus the tube 50 and pump head 30, upward in the direction of Arrow B until the foam pump 14 is in the extended position. As the foam pump 14 is moved back into the extended position, the striker 26 is moved upward out of the cap 22 and the diaphragm 34 returns to its non-collapsed form as shown in FIG. 5.

The foam pump 14 may be assembled by positioning the inlet ball 70 in the cavity 101 of the liquid pump body 42 through the hole 99 in the base 98 until the ball 70 is received within the seat 118 inside the liquid pump body 42. The spring 62 is then inserted into the cavity 101 in a similar manner such that the bottom end 94 of the spring 62 engages the inlet ball 70. The diaphragm 34 is positioned on the pump head tube 50. The outlet ball 66 is then positioned on the seat 78 of the spring support 58, and the spring support 58 is then inserted into the cavity 136 of the pump head tube 50. The pump head tube 50, carrying the spring support 58, is then inserted into the cavity 101 of the liquid pump body 42 through the hole 99 in the base 98 such that an upper portion of the spring 62 is received in the pump head tube 50 and the top end 90 of the spring 62 receives the end 82 of the spring support 58 and engages the ledge 86 of the spring support 58. The rim 36 of the diaphragm 34 is inserted into the groove 110 such that the pump head 30 is secured to the cap 22. The interior side wall 102, base 98, and diaphragm 34 define an air chamber 106.

Figure 7:
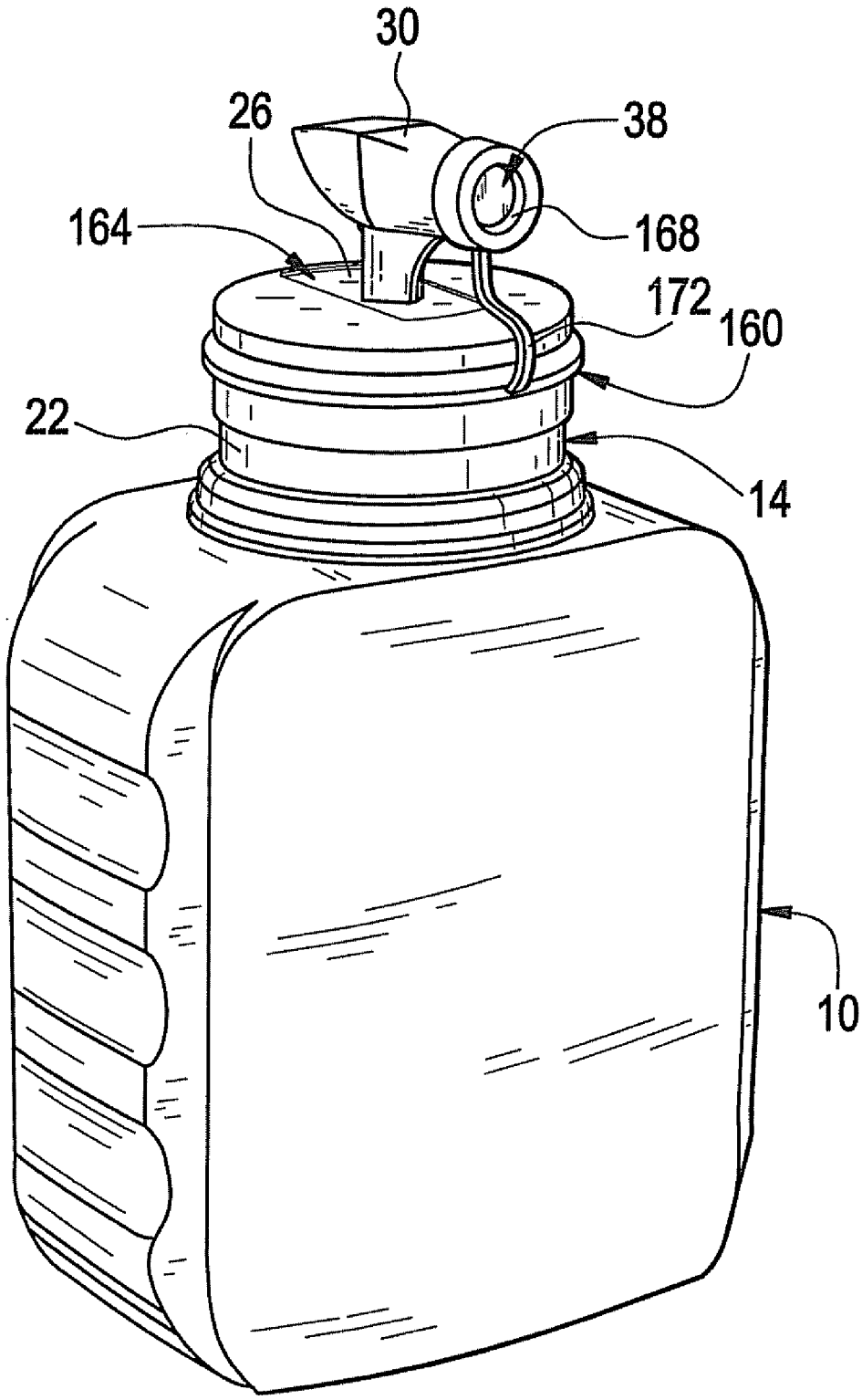
FIG. 7 illustrates a front isometric view of the dispenser of FIG. 1 with a securing cap attached thereto.

FIG. 7 illustrates a front isometric view of the dispenser 10 with a cylindrical securing cap 160 attached thereto. The cap 160 fits over the striker 26 and cap 22 of the foam pump 14 to hold the foam pump 14 in the depressed position. The cap 160 includes a slot 164 which allows the cap 160 to be fit over the pump head 30. By securing the foam pump 14 in the depressed position, the cap 160 prevents the dispenser 10 from being accidentally activated during transit and thus prevents the dispenser 10 from leaking soap during transit. The cap 160 includes a cylindrical plug 168 connected thereto by a flexible strand 172. The plug 168 covers the mouth 38 of the pump head 30 to prevent soap from leaking from the mouth 38 and to prevent contaminants from entering the dispenser 10. The cap 160 may be made of a flexible material such as plastic or rubber. In an alternative embodiment, the foam pump 14 may be secured in the depressed position by a number of other features or methods such as, by way of example only, clips, locking mechanisms, or screw-tops.

Figure 8:
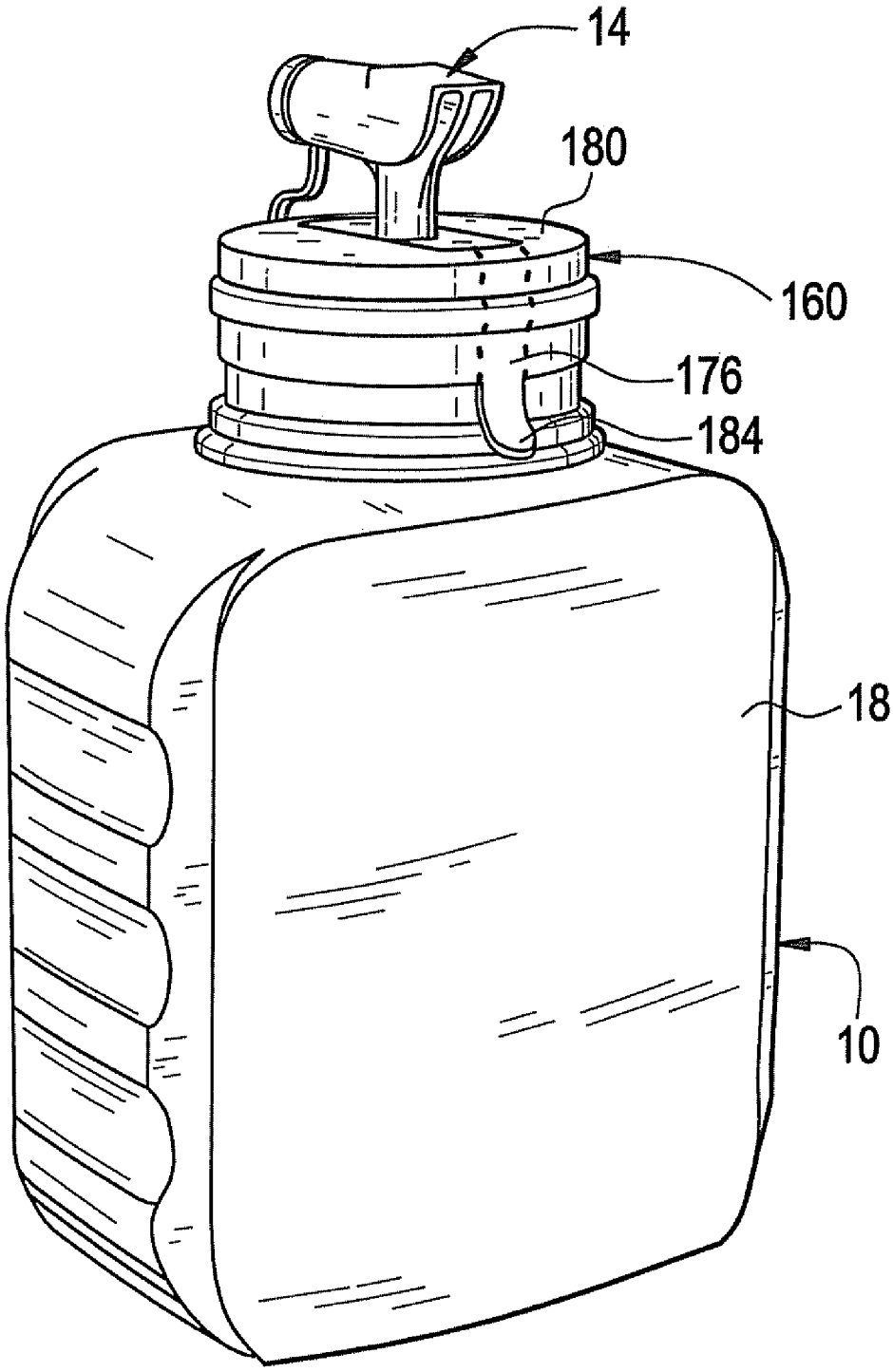
FIG. 8 illustrates a rear isometric view of the dispenser of FIG. 7.

FIG. 8 illustrates a rear isometric view of the dispenser 10 of FIG. 7. The cap 160 includes a tear-away strip 176 that is defined by perforations 180 on the cap 160. The strip 176 includes a tab 184. A user pulls the tab 184 to tear the strip 176 from the cap 160 along the perforations 180. The user then removes the nozzle cap 168 from the pump head 30 and the rest of the cap 160 from the cap 22 and striker 26 in order to use the dispenser 10.

In operation, when the foam pump 14 is assembled with the container 18, the foam pump 14 is locked in the depressed position by attaching the cap 160 to the foam pump 14. The entire dispenser 10 is then shipped to distributors and consumers in the depressed position so that the dispenser 10 does not leak while in transit. Referring to FIGS. 5 and 6, upon receipt of the dispenser 10 (FIG. 1), a consumer may dispense soap by removing the cap 160 (FIG. 7) so that spring 62 is allowed to decompress and move the foam pump 14 into the extended position. As the tube 50 moves upward in the direction of Arrow B, a low pressure is created in the liquid chamber 122 by the seal 126 between the pump head tube 50 and the liquid pump body 42 and outlet ball 66 being in the seat 78. The vacuum draws liquid soap in the direction of arrow B up from the passageway 116 such that the liquid soap pushes the inlet ball 70 out of the seat 118 and flows between the ball 70 and seat 78 into the liquid chamber 122. Similarly, as the foam pump 14 moves into the extended position, the diaphragm 34 is expanded and draws air through the mouth 38, mixing chamber 134, air passageway 144, and air inlet 140 into the air chamber 106.

The consumer then dispenses foamed soap by pushing the pump head 30 down in the direction of Arrow A such that the foam pump 14 is moved into the depressed position. As the pump head tube 50 moves downward in the direction of Arrow A within the liquid pump body 42, the liquid soap in the liquid chamber 122 goes through the second liquid passageway 132 of the end 82 of the spring support 58 and pushes the outlet ball 66 upward and out of the seat 78 such that the liquid soap flows into the gap 74 and continues upward through the first liquid passageway 130 of the spring support 58 into the mixing chamber 134. The tab 80 keeps the outlet ball 66 from being pushed up to block the first passageway 130. At the same time, air is pushed by the collapsing diaphragm 34 from the air chamber 106 through the air inlet 140 into the air passageway 144 and the air flows through the passageway 144 into the mixing chamber 134. As the diaphragm 34 collapses, air may also be pushed through the air hole 148 into the container 18 (FIG. 1) to replace the volume of liquid removed from the container 18 and thus prevent the container 18 from collapsing.

As the liquid soap and air enter the mixing chamber 134 together, the liquid soap and air engage the static mixing feature 138 which creates turbulence in the paths of the liquid soap and air and causes the liquid soap and air to combine and commingle into a liquid-air mixture. The liquid-air mixture then flows in the direction of Arrow C through the gauze tubes 54 and out of the mouth 38 of the pump head 30. As the pressurized liquid-air mixture is forced through the gauze tubes 54, the porous members of the gauze tubes 54 further mixes the liquid-air mixture into a foam and a foamed soap mixture is dispensed from the mouth 38. After the foamed soap is dispensed, the consumer releases the pump head 30 and the spring 62 decompresses to return the foam pump 14 back to the extended position. As the foam pump 14 returns to the extended position, liquid soap is again drawn into the liquid chamber 122 and air is drawn into the air chamber 106 such that the process of dispensing foamed soap may be repeated. Additionally, as the diaphragm 34 is re-inflated and draws air through the mouth 38 and into the air chamber 106, any foam that is left in the mouth 38 is drawn back into the pump head 30. In this way, the foam pump 14 is self-cleaning after dispensing foam.

In an alternative embodiment, the foam pump 14 may be configured for use in a wall-mounted soap dispenser to dispense foamed soap. In addition, the foam pump 14 may be configured for use in either an upright or inverted position within the wall-mounted soap dispenser. When the pump 14 is used in an inverted position, the hole 148 is blocked so that air does not enter the container 18 from the air chamber 106.

In an alternative embodiment, the foam pump 14 may use valves instead of inlet and outlet balls to prevent and/or allows the flow of liquid into and out of the liquid chamber 122.

The different embodiments of the foamed soap dispenser of the present invention provide several advantages over conventional foamed soap dispenser systems. The pump is assembled from only three subparts: the cap, the spring system, and the pump head. During assembly of the pump, a worker simply places the spring system in the tube of the cap and then inserts the tube of the pump head into the cap and snaps the diaphragm into place in the cap. By using fewer sub-assembly parts, the pump is cheaper and easier to manufacture and assemble than conventional foamer pumps. Furthermore, because the roamer pump includes a cap to secure the pump assembly in the depressed position during transit, the foamer pump cannot accidentally be depressed and leak and/or dispense soap during transit.

While various spatial terms, such as, for example, upper, lower, mid, lateral, horizontal, vertical, top, back, rear, front and the like may used to describe portions of the floor box, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A pump assembly configured to be secured to a container comprising:

a pump body that forms a liquid pump body that defines a pump body cavity that extends through the liquid pump body to an inlet passage that communicates with an interior of the container;

an inlet valve mounted to the liquid pump body that opens in response to pressure in the container that is greater than pressure in the pump body cavity and that closes to prevent communication between the interior of the container and the pump body cavity in response to pressure in the pump body cavity that is greater than pressure in the container;

a pump head including a nozzle section at an upper end of the pump head and a head tube extending from the nozzle section, the nozzle section defines a mouth, the pump head defines a pump head cavity that extends from the mouth through the head tube, and an outer surface of the head tube is sized and configured to closely fit within the pump body cavity so that the head tube slidingly moves within and along the pump body cavity;

a porous member is positioned within the pump head cavity;

a spring support sized to at least partially extend into the pump head cavity, the spring support:

formed to prevent passage of liquid around the spring support into the pump head tube cavity, defining a spring support passage that communicates with the pump head cavity and the pump body cavity, extending through the pump head cavity from the location at which the spring support prevents passage of liquid around the spring support into the head tube cavity, and being separated in the pump head cavity from the pump head tube to define an air passage between the pump head tube and the spring support;

an outlet valve mounted to the spring support to permit communication through the spring support between the pump head cavity and the pump body cavity in response to pressure in the pump body cavity and that closes to prevent communication between the pump head cavity and the pump body cavity when not opened by pressure in the pump body cavity;

a pump spring positioned at least partially within the pump body cavity that urges the pump head tube and spring support away from the inlet passage;

a flexible diaphragm secured to the pump head at a location separated from the pump body, extending around the pump head and extending from the location at which it is secured to the pump head to the pump body, the diaphragm, the pump body and the pump head defining an air chamber and movement of the pump head tube toward the inlet passage deforms the diaphragm and thereby reduces the volume of the air chamber; and the pump head defining one or more air passageways that communicate between the air chamber and the air passage between the pump head tube and the spring support.

2. The pump of claim 1, wherein said outlet valve is retained by the spring support.

3. The pump of claim 1, wherein the spring abuts the spring support and the spring support abuts the pump head tube whereby the spring urges the spring support and through the spring support the pump head tube away from the inlet passage.

4. A pump that mounts to a bottle, makes a foam of the liquid in the bottle and dispenses the foam, the pump comprising:

a pump body that forms a liquid pump body that defines a pump body cavity that extends through the liquid pump body to an inlet passage that communicates with an interior of the bottle;

an inlet valve mounted to the liquid pump body that opens in response to pressure in the bottle that is greater than pressure in the pump body cavity and that closes to prevent communication between the interior of the bottle and the pump body cavity in response to pressure in the pump body cavity that is greater than pressure in the bottle;

a pump head including a nozzle section at an upper end of the pump head and a head tube extending from the nozzle section, the nozzle section defines a mouth, the pump head defines a pump head cavity that extends from the mouth through the head tube, and an outer surface of the head tube is sized and configured to closely fit within the pump body cavity so that the head tube slidingly moves within and along the pump body cavity;

a porous member is positioned within the pump head cavity;

a spring support sized to at least partially extend into the pump head cavity, the spring support:

formed to prevent passage of liquid around the spring support into the pump head tube cavity, defining a spring support passage that communicates with the pump head cavity and the pump body cavity, the spring support extends through the pump head cavity from the location at which the spring support prevents passage of liquid around the spring support into the head tube cavity, and at least a portion of the spring support in the pump head cavity is separated from the pump head tube to define an air passage between the pump head tube and the spring support that communicates with the pump head cavity;

an outlet valve mounted to the spring support to permit communication between the pump head cavity and the pump body cavity in response to pressure in the pump body cavity and that closes to prevent communication between the pump head cavity and the pump body cavity when not opened by pressure in the pump body cavity;

a pump spring positioned at least partially within the pump body cavity that urges the pump head tube and spring support away from the inlet passage;

a flexible diaphragm secured to the pump head at a location separated from the pump body, extending around the pump head and extending from the location at which it is secured to the pump head to the pump body, the diaphragm, the pump body and the pump head defining an air chamber and movement of the pump head tube toward the inlet passage deforms the diaphragm and thereby reduces the volume of the air chamber;

the pump head defining one or more air passageways that communicate with the air chamber and the air passage defined by the pump head tube and the spring support whereby liquid passes through the spring support passage and air passes through the air passage to mix at a location between the spring support and the porous member.

5. The pump of claim 4, wherein said outlet valve is retained by the spring support.

6. The pump of claim 4, wherein the spring abuts the spring support and the spring support abuts the pump head tube whereby the spring urges the spring support and through the spring support the pump head tube away from the inlet passage.

7. The pump of claim 4, wherein the spring abuts the inlet valve to urge the inlet valve closed to prevent communication between the pump body cavity and the interior of the bottle.

8. The pump of claim 4, wherein the pump head includes a striker that is positioned between the diaphragm and the nozzle section, the striker and the pump body configured such that the striker is received by the pump body when the pump head tube is substantially within the pump body cavity.

9. The pump of claim 8, wherein the striker and the pump body are configured to enclose the diaphragm when the pump head tube is substantially within the pump body cavity.

10. The pump of claim 8, wherein the pump body defines an air passage that communicates with the air chamber and the interior of the container, the air passage located to be overlain by the diaphragm when the pump head tube substantially within the pump body cavity.

11. A foamed soap dispenser, comprising:

a container carrying liquid soap;

a pump assembly connected to said container, said pump assembly including a pump head portion, a spring portion and a cap portion;

said pump head portion including a tube and a diaphragm and said cap portion being configured to receive said tube and to be connected to said diaphragm to define an air chamber, said spring portion including a spring and a support member that is at least partially received within said tube, said spring portion defining a liquid chamber that receives liquid from said container, said liquid chamber and air chamber being in communication with a mixing chamber in said pump head portion proximate a porous member, said support member and said tube define an air passageway that extends from said mixing chamber to an air inlet defined by the tube that communicates with said air chamber and said air passageway wherein when said pump head portion is moved to a depressed position, said support member is configured to compress said spring such that liquid flows from said liquid chamber to said mixing chamber and said diaphragm is collapsed such that air flows from said air chamber to said mixing chamber whereby said air and liquid commingle in said mixing chamber and the air liquid mixture passes through said porous member and is dispensed from said pump head as a foam.

12. The dispenser of claim 11, wherein said cap portion includes an air hole that extends between said air chamber and said container such that when liquid is drawn from said container into said pump assembly, air flows from said air chamber into said container.

13. The dispenser of claim 11, wherein said pump head portion includes a disc that is configured to be received within said cap portion and cover said diaphragm within said cap portion when said pump head portion is fully depressed and said diaphragm is collapsed within said cap portion.

14. The dispenser of claim 11, wherein said cap portion includes an air hole that extends between said air chamber and said container, said diaphragm covering said air hole when said diaphragm is collapsed.

15. The dispenser of claim 11, further including a securing cap, said securing cap releasably engaging said pump head portion to maintain said pump head portion in said depressed position.

16. The dispenser of claim 11, wherein said support member includes a liquid passageway that extends from said liquid chamber to said mixing chamber.

17. The dispenser of claim 16, wherein said spring portion includes an outlet valve that is mounted in said support member to block, and allow, the passage of liquid from said liquid chamber to said liquid passageway and an inlet valve mounted in said cap portion to block, and allow, the passage of liquid from said container into said liquid chamber, wherein when said spring is compressed, liquid flows from said liquid chamber past said outlet valve into said liquid passageway and when said spring is decompressed, liquid flows past said inlet valve into said liquid chamber from container.

* * * * *